US008593301B2

(12) United States Patent
Newman

(10) Patent No.: US 8,593,301 B2
(45) Date of Patent: Nov. 26, 2013

(54) METHOD AND SYSTEM FOR TRANSMITTING A WARNING MESSAGE TO A DRIVER OF A VEHICLE

(76) Inventor: Timothy Newman, Belleville (CA)

( * ) Notice: Subject to any disclaimer, the term of this patent is extended or adjusted under 35 U.S.C. 154(b) by 302 days.

(21) Appl. No.: 13/065,422

(22) Filed: Mar. 22, 2011

(65) Prior Publication Data

US 2011/0260885 A1 Oct. 27, 2011

Related U.S. Application Data

(60) Provisional application No. 61/282,939, filed on Apr. 27, 2010.

(51) Int. Cl.
*G08G 1/00* (2006.01)

(52) U.S. Cl.
USPC ..... 340/902

(58) Field of Classification Search
USPC ..... 340/902, 906, 426.16, 539.1, 903, 340/13.24
See application file for complete search history.

(56) References Cited

U.S. PATENT DOCUMENTS 4,241,326 A * 12/1980 Odom ..... 340/333
5,757,284 A * 5/1998 Trizzino et al. ..... 340/902
7,663,504 B2 * 2/2010 Votaw et al. ..... 340/902
2003/0164775 A1 * 9/2003 Hutchison et al. ..... 340/902
2004/0201494 A1 * 10/2004 Tringali et al. ..... 340/902
2005/0073432 A1 * 4/2005 Melman ..... 340/902
2006/0255966 A1 * 11/2006 McKenna ..... 340/902

* cited by examiner

*Primary Examiner* — Phung Nguyen
(74) *Attorney, Agent, or Firm* — Frank J. Bonini, Jr.; John F. A. Earley, III; Harding, Earley, Follmer & Frailey, P.C.

(57) ABSTRACT

A method and system for transmitting a warning message to a driver of a vehicle is provided. Authorization for uploading message data is provided followed by the provision of message data indicative of a plurality of pre-recorded warning messages. The message data are then stored in memory of the transmitter. A responder of the emergency vehicle selects one of the plurality of pre-recorded warning messages. The message data associated with the selected warning message are then encoded and encrypted. The encrypted message data are then processed to generate a RF signal in dependence thereupon which is then transmitted to the vehicle. Upon receipt of the RF signal at the vehicle message data are generated in dependence thereupon which are then decrypted and decoded. The decoded message data are then provided to the entertainment system of the vehicle and the operation of the entertainment system is controlled such that the warning message is broadcast when the entertainment system is turned off and such that provision of other audio signals is interrupted for broadcasting the warning message when the entertainment system is turned on.

14 Claims, 7 Drawing Sheets

METHOD AND SYSTEM FOR TRANSMITTING A WARNING MESSAGE TO A DRIVER OF A VEHICLE

BACKGROUND OF THE INVENTION

1. Field of the Invention

The present invention relates to the field of warning systems, and more particularly to a method and system for transmitting a warning message to a driver of a vehicle.

2. Brief Description of the Related Art

Currently emergency vehicles use loud sirens and flashing lights for alerting drivers from the outside of their vehicle. However, audio alerts from the outside are unreliable. Firstly, modern cars are built soundproof in order to substantially prevent outside noise from penetrating the car for driver and passenger comfort. Secondly, most modern cars have a built-in entertainment system typically comprising a radio, CD player and a DVD player. As a result, drivers are typically exposed to a noisy environment created inside the vehicle preventing the same from becoming aware of the outside audio alert from an approaching emergency vehicle.

There have been various attempts to overcome this problem. For example, U.S. Pat. Nos. 5,926,112 and 6,822,580 teach use of a flashing light or a warning tone generated inside the vehicle which is triggered by an approaching emergency vehicle. Further, U.S. Pat. No. 7,061,402 teaches use of the sound waves of the siren of an approaching emergency vehicle to trigger the generation of a warning tone within the vehicle and U.S. Pat. No. 7,663,504 teaches an emergency vehicle sending a signal which triggers playing of a generic message which is stored in the receiver and which can not be customized by an emergency department.

Unfortunately, these and other state of the art systems have shortcomings preventing the same from successful implementation. The state of the art systems can be triggered by other signals then signals transmitted from an emergency vehicle either accidentally or intentionally. Furthermore, the state of the art systems do not interrupt the current operation of the entertainment system to broadcast the warning signal or warning message. Yet further, the state of the art systems do not provide means for muting one transmitter in the presence of another potentially jamming the system in the presence of more than one emergency vehicle.

It is desirable to provide a method and system for transmitting a warning message to a driver of a vehicle that is reliable.

It is also desirable to provide a method and system for transmitting a warning message to a driver of a vehicle that temporarily interrupts a current operation of the entertainment system of the vehicle to broadcast the warning message and that broadcasts the warning message when the entertainment system is turned off.

It is also desirable to provide a method and system for transmitting a warning message to a driver of a vehicle that provides means for muting one transmitter in the presence of another.

SUMMARY OF THE INVENTION

Accordingly, one object of the present invention is to provide a method and system for transmitting a warning message to a driver of a vehicle that is reliable.

Another object of the present invention is to provide a method and system for transmitting a warning message to a driver of a vehicle that temporarily interrupts a current operation of the entertainment system of the vehicle to broadcast the warning message and that broadcasts the warning message when the entertainment system is turned off.

Another object of the present invention is to provide a method and system for transmitting a warning message to a driver of a vehicle that provides means for muting one transmitter in the presence of another.

According to one aspect of the present invention, there is provided a device for transmitting a warning message to a driver of a vehicle. The transmitter comprises a storage medium for storing message data indicative of a plurality of pre-recorded warning messages. Selecting circuitry is connected to the storage medium for selecting one of the plurality of pre-recorded warning messages. An encoding module is connected to the selecting circuitry for encoding the message data associated with the selected warning message. An encryption module is connected to the encoding module for encrypting the encoded message data. A radio transmitter is connected to the encryption module for generating a radio frequency signal in dependence upon the encrypted message data and an antenna is connected to the radio transmitter for transmitting the radio frequency signal to the vehicle.

According to another aspect of the present invention, there is further provided a device for receiving a warning message and broadcasting the same to a driver of a vehicle. The receiver comprises an antenna for receiving a radio frequency signal indicative of a warning message to the driver of the vehicle. A radio receiver is connected to the antenna for generating message data in dependence upon the received radio frequency signal. A decrypting module is connected to the radio receiver for decrypting the message data. A decoding module is connected to the decrypting module for decoding the decrypted message data and switching circuitry is connected to the decoding module. The switching circuitry is for being connected to an entertainment system of the vehicle for providing the message data and for controlling operation of the entertainment system such that the warning message is broadcast when the entertainment system is turned off and such that provision of other audio signals is interrupted for broadcasting the warning message when the entertainment system is turned on.

According to another aspect of the present invention, there is further provided a method for transmitting a warning message to a driver of a vehicle. Authorization for uploading message data is provided followed by the provision of message data indicative of a plurality of pre-recorded warning messages. The message data are then converted into a custom file format and stored in memory of the transmitter. A responder of the emergency vehicle selects one of the plurality of pre-recorded warning messages. The message data associated with the selected warning message are then encoded and encrypted. The encrypted message data are then processed to generate a RF signal in dependence thereupon which is then transmitted to the vehicle. Upon receipt of the RF signal at the vehicle message data are generated in dependence thereupon which are then decrypted and decoded. The decoded message data are then provided to the entertainment system of the vehicle and the operation of the entertainment system is controlled such that the warning message is broadcast when the entertainment system is turned off and such that provision of other audio signals is interrupted for broadcasting the warning message when the entertainment system is turned on.

The advantage of the present invention is that it provides a method and system for transmitting a warning message to a driver of a vehicle that is reliable.

A further advantage of the present invention is that it provides a method and system for transmitting a warning message to a driver of a vehicle that temporarily interrupts a current operation of the entertainment system of the vehicle to broadcast the warning message and that broadcasts the warning message when the entertainment system is turned off.

A further advantage of the present invention is that it provides a method and system for transmitting a warning message to a driver of a vehicle that provides means for muting one transmitter in the presence of another.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

Figure 1A:
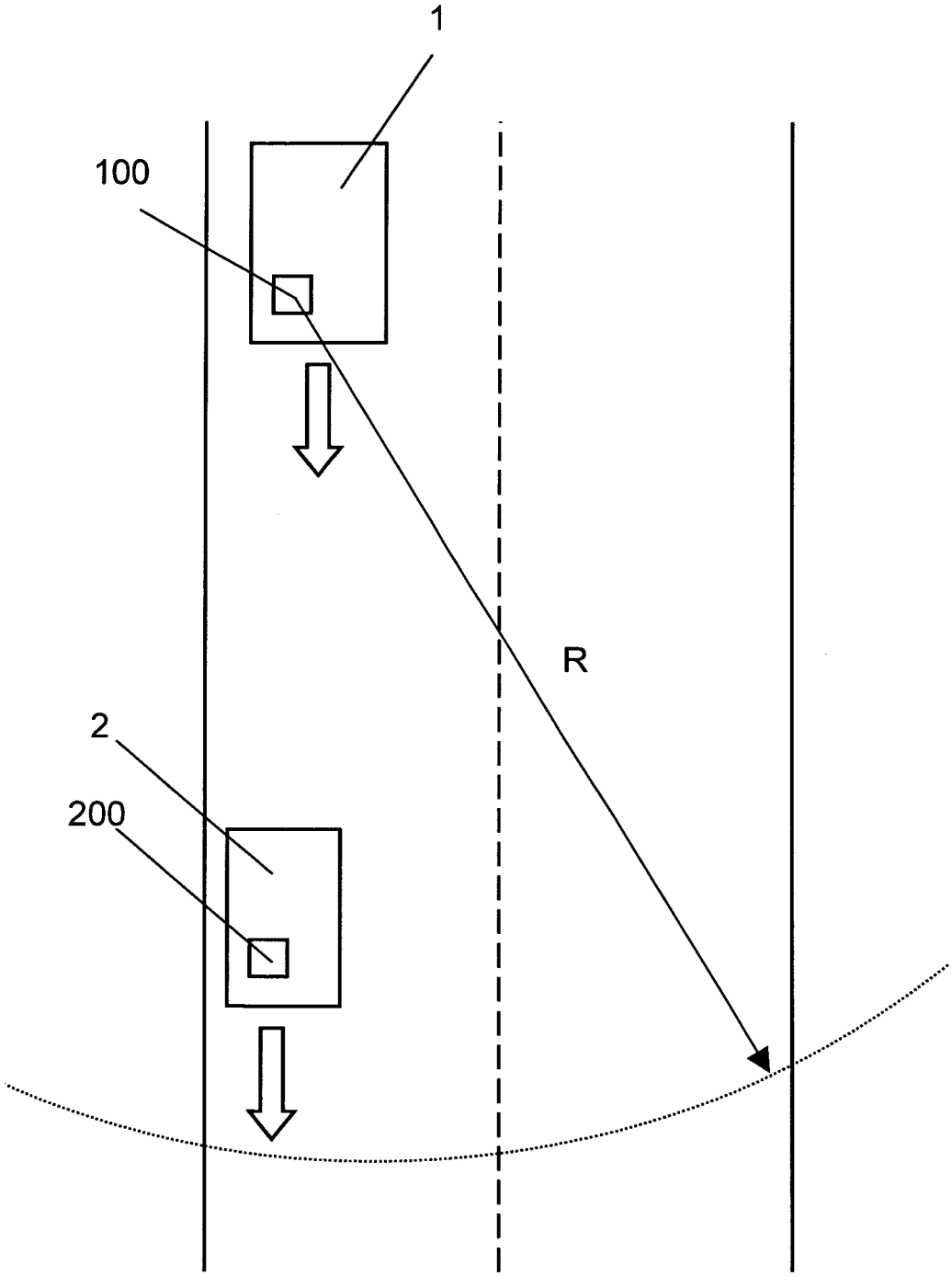
FIGS. 1*a* and 1*b* are simplified block diagrams illustrating operation of a system for transmitting a warning message to a driver of a vehicle according to a preferred embodiment of the invention.
Figure 2A:
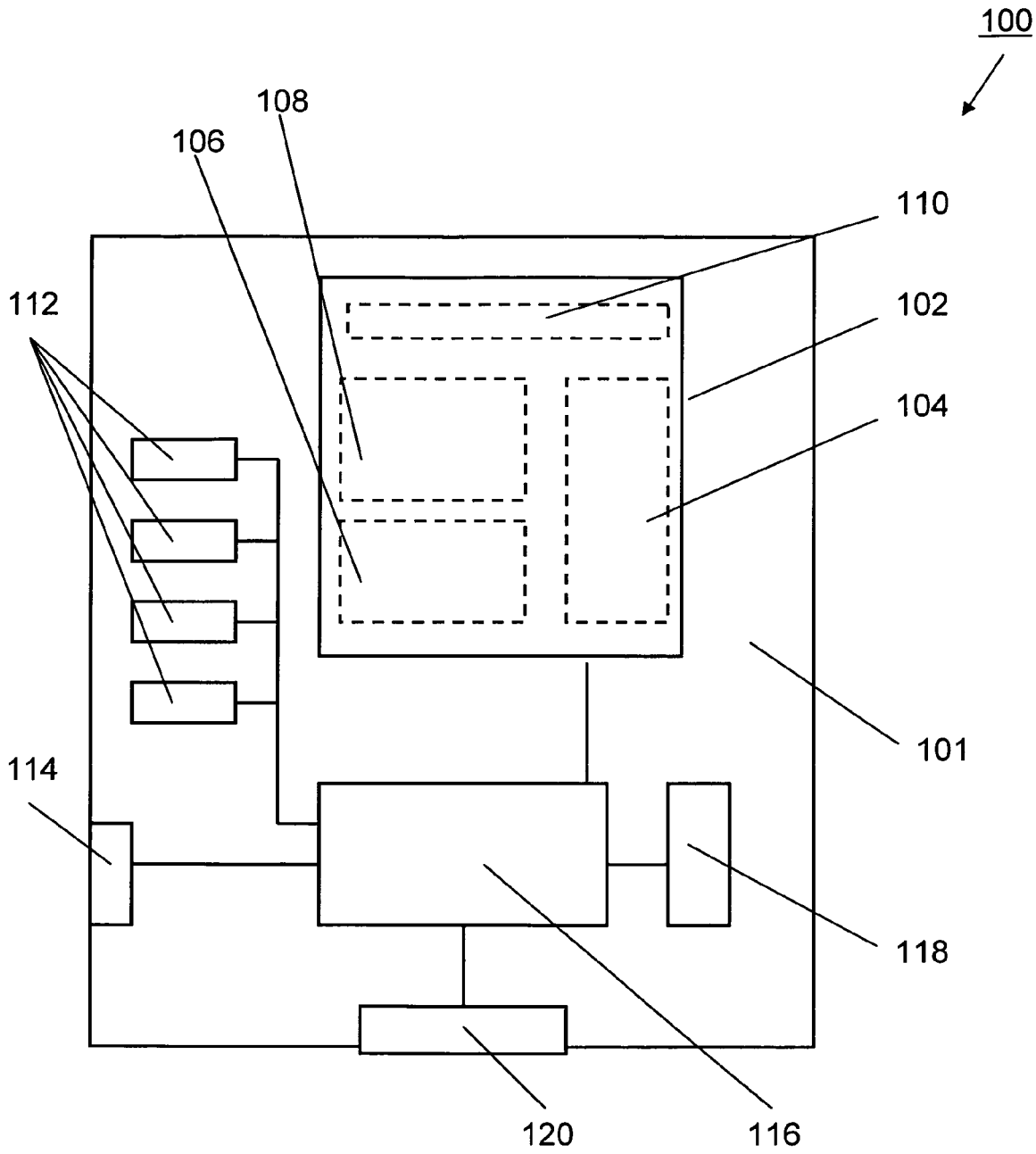
FIG. 2*a* is a simplified block diagram illustrating a transmitter of the system for transmitting a warning message to a driver of a vehicle according to a preferred embodiment of the invention.
Figure 2B:
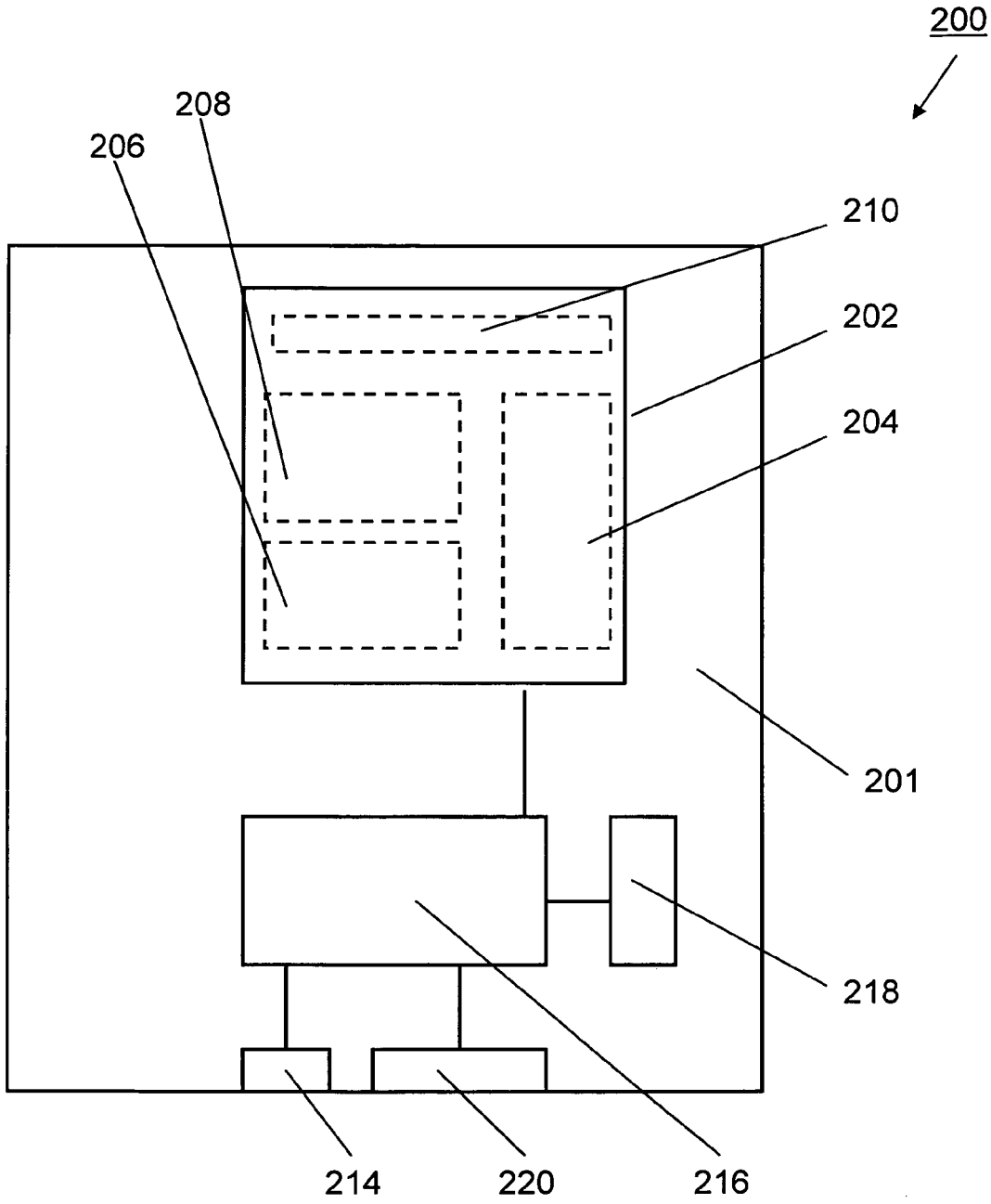
FIGS. 2*b* and 2*c* are simplified block diagrams illustrating a receiver of the system for transmitting a warning message to a driver of a vehicle according to a preferred embodiment of the invention; and, FIG. 3 is simplified flow diagram illustrating a method for transmitting a warning message to a driver of a vehicle according to a preferred embodiment of the invention.
Figure 2C:
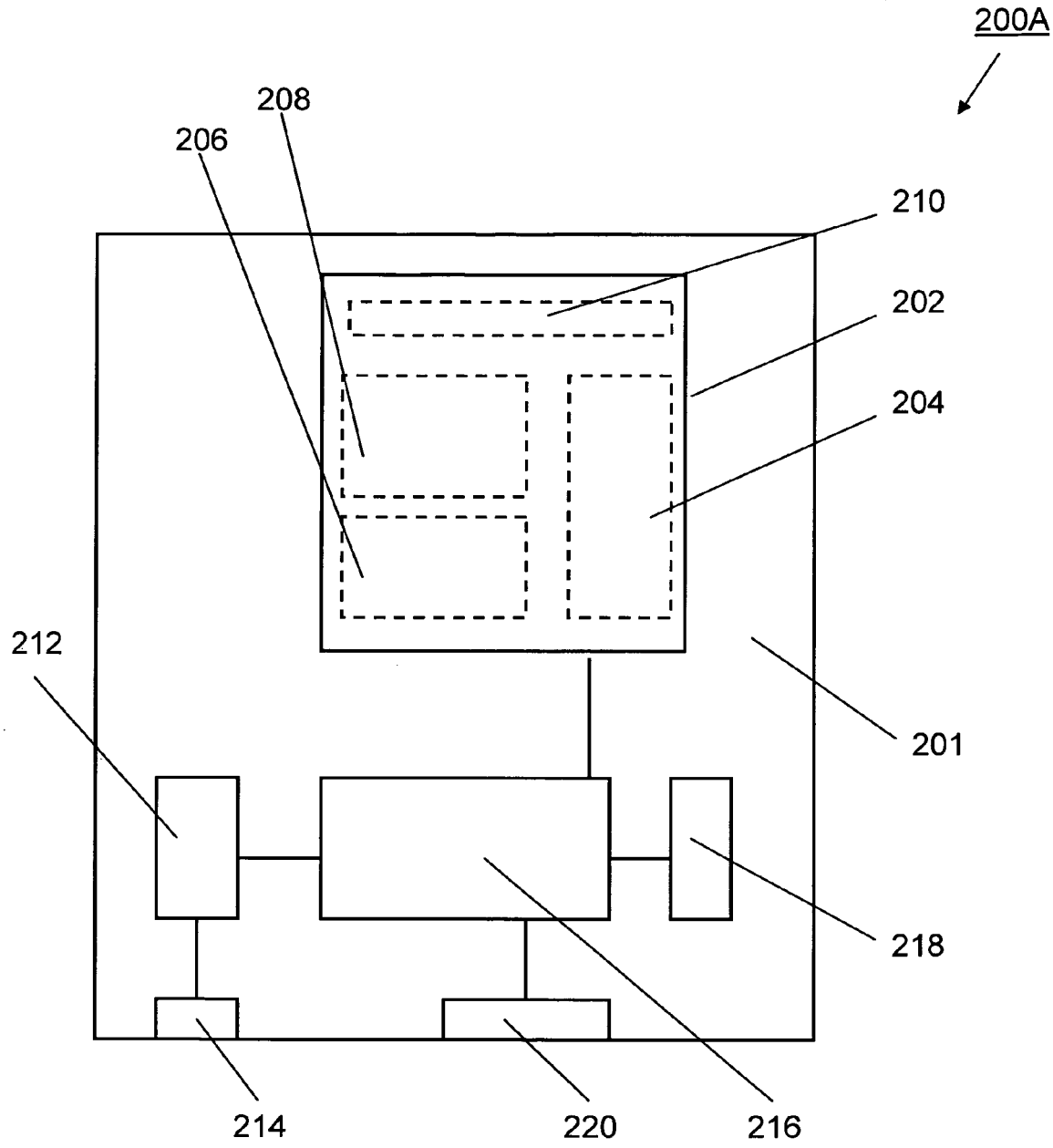
Figure 3:
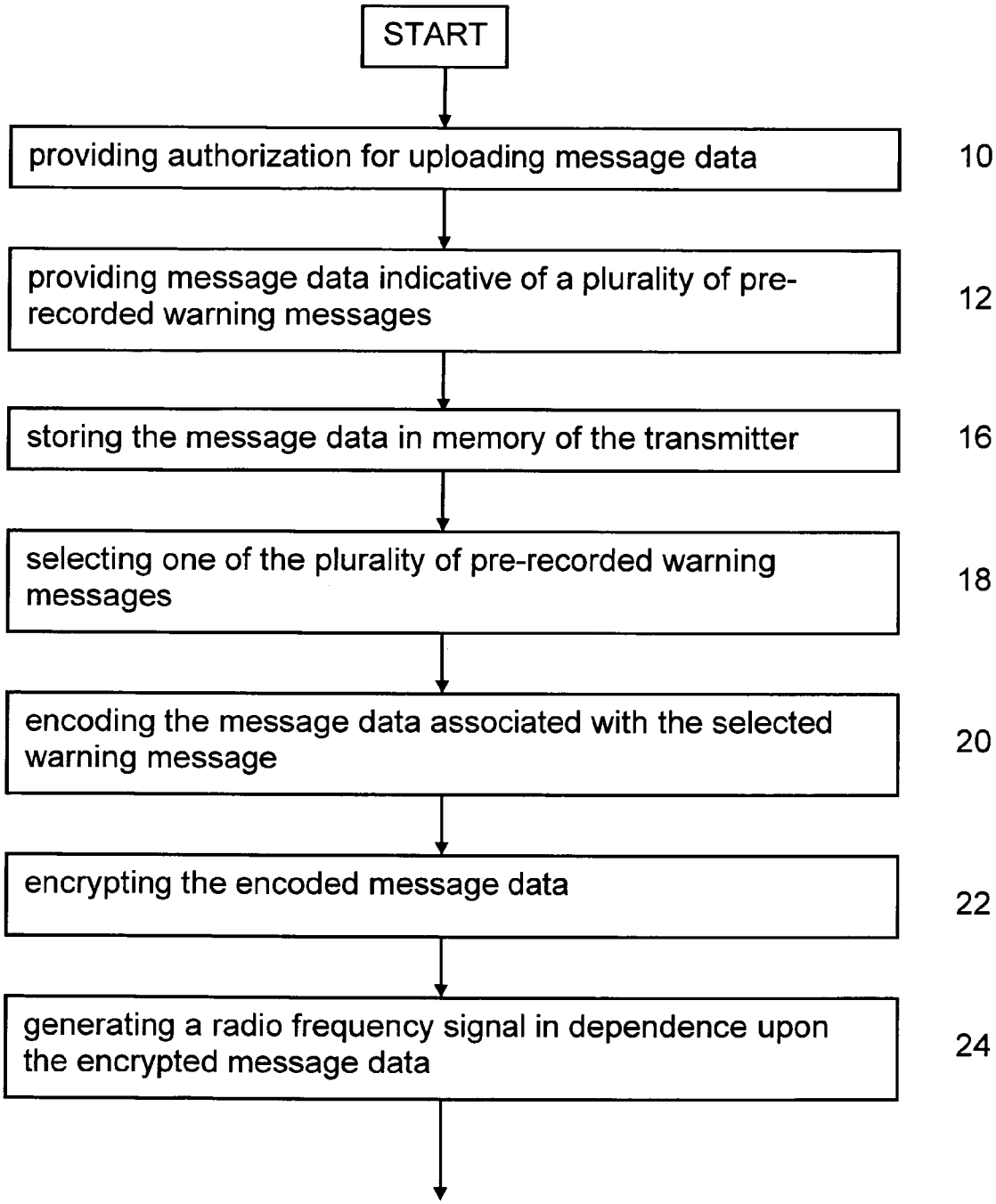
Figure 3:
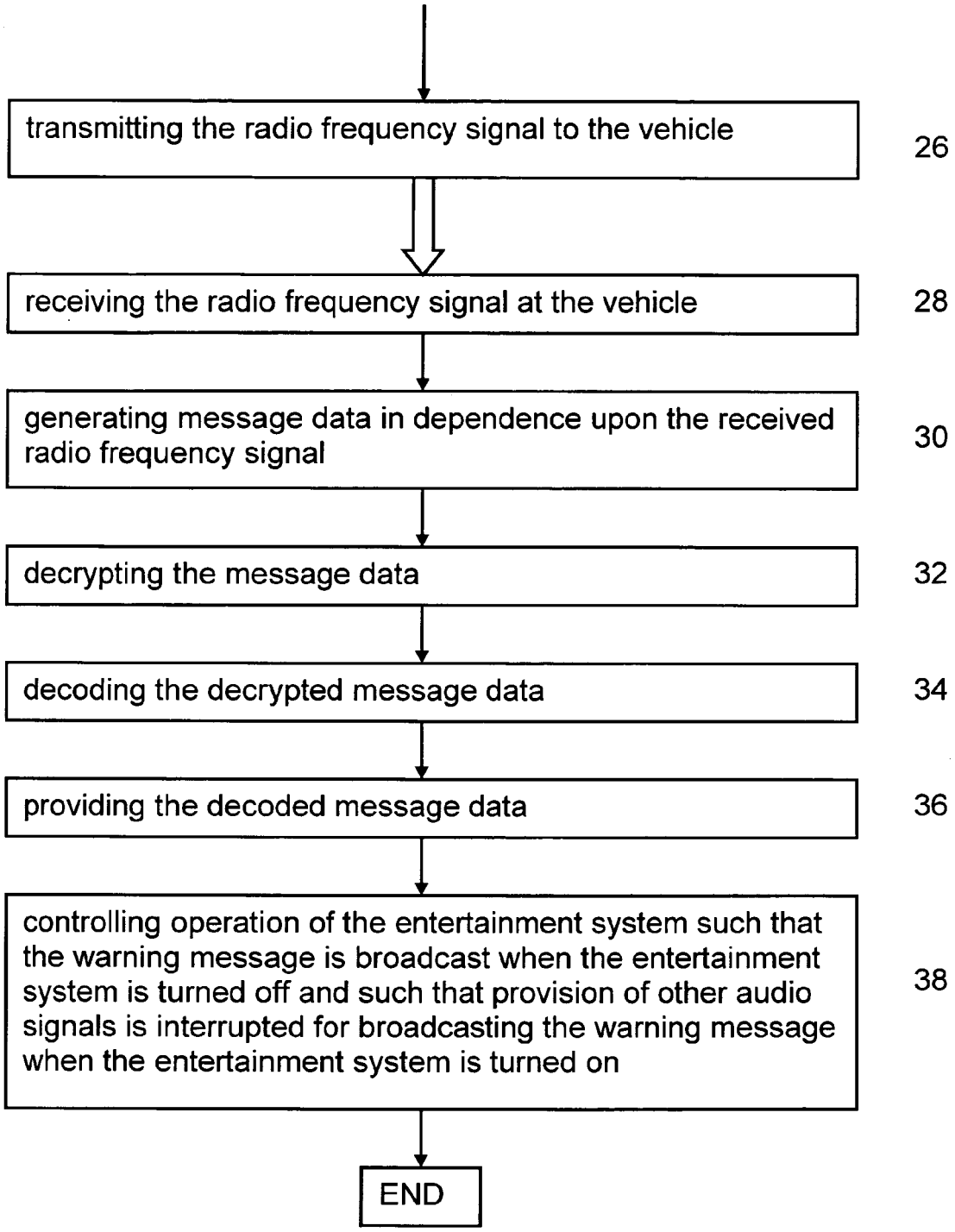

Referring to FIGS. 1 to 3, a method and system for transmitting a warning message to a driver of a vehicle according to a preferred embodiment of the invention is provided. The system comprises a transmitter 100 according to a preferred embodiment of the invention disposed in an emergency vehicle 1 such as, for example, a police car, an ambulance, or a fire truck. The transmitter 100 emits a Radio Frequency (RF) signal at a predetermined strength such that the RF signal is received within a predetermined range R from the emergency vehicle 1, as illustrated in FIG. 1*a*. A receiver 200 according to a preferred embodiment of the invention disposed in vehicle 2 receives the RF signal within the predetermined range R from the emergency vehicle 1 and generates a warning message in dependence upon the received RF signal which is then broadcast to the driver of the vehicle 2 using the built-in entertainment system of the vehicle 2, as will be described in more detail herein below.

The transmitter 100, illustrated in FIG. 2*a*, comprises as main components storage medium 112, control circuitry 116, encoding module 104, encrypting module 106, radio transmitter 108, and antenna 110 disposed on circuit board 101. Preferably, the storage medium 112 comprises a plurality of non-volatile memory chips such as, for example, off-the-shelf 8 Mbit Serial Flash Memory, each for storing message data indicative of one warning message. Control circuitry 116 such as, for example, a suitable off-the-shelf micro processor, controls: storage of the message data; retrieval of message data indicative of a selected warning message; and provision of the same to the encoding module 104, by executing executable commands stored in non-volatile memory 118. The message data are then encoded according to—for example, a standard voice Codec—in the encoding module 104. The encoded message data are then encrypted—for example, using a 128 bit standard encryption process—in encryption module 106. The radio transmitter 108 then generates a RF signal in dependence upon the encrypted message data for transmission using the antenna 110. Preferably, the radio transmitter generates a RF signal having a frequency—for example, 2.4 GHz—within a license free frequency range for allowing broadcast in the United States and Canada. Further preferably, the encoding module 104, the encrypting module 106, the radio transmitter 108, and the antenna 110 are integrated in a single chip 102 such as, for example, the off-the-shelf CEL RF Module with PCB Trace Antenna which emits a RF signal at a frequency of 2.4 GHz. It is noted that the CEL RF Module has modular approval from the FCC and Industry Canada for broadcasting.

In order to address the need for different warning messages in different situations, the transmitter 100 enables uploading of a plurality of different pre-recorded warning messages in a standard file format, thus enabling customization of the warning messages by the respective emergency department. A responder in the emergency vehicle 1 is then able to select the warning message that best fits the situation. The message data are uploaded using port 114 such as, for example, a USB port or a memory card interface for providing the same for storage in the storage medium 112. Uploading of the message data is controlled by control circuitry 116, preferably, in dependence upon a predetermined user authorization such as a password to prevent tampering.

Preferably, the message data are generated using standard recording equipment and are then converted form the standard file format such as, for example, the MP3 file format, into a custom file format prior uploading of the same to the transmitter. For example, the recorded messages are sent to the manufacturer for conversion into the custom file format and loading onto the transmitter. The transmitter is then shipped with the pre-recorded message to the emergency department. Alternatively, the conversion is performed, for example, by executing custom conversion software specific for this conversion process on a secure computer of the respective emergency department. Conversion into a custom file format and programming of the encoding module 104 to recognize only message data in the custom file format further increases security against tampering by rendering the encoding module 104 incapable to recognize other file formats.

The transmitter 100 further comprises interface 120 connected to the control circuitry 116. The interface 120 enables user interaction for activating the transmitter 100 and selecting one of the pre-recorded message data. The interface 120 comprises, for example, push buttons for enabling user interaction in the emergency vehicle 1. Alternatively, the interface 120 is designed for being connected with an on-board computer system of the emergency vehicle 1.

Figure 1B:
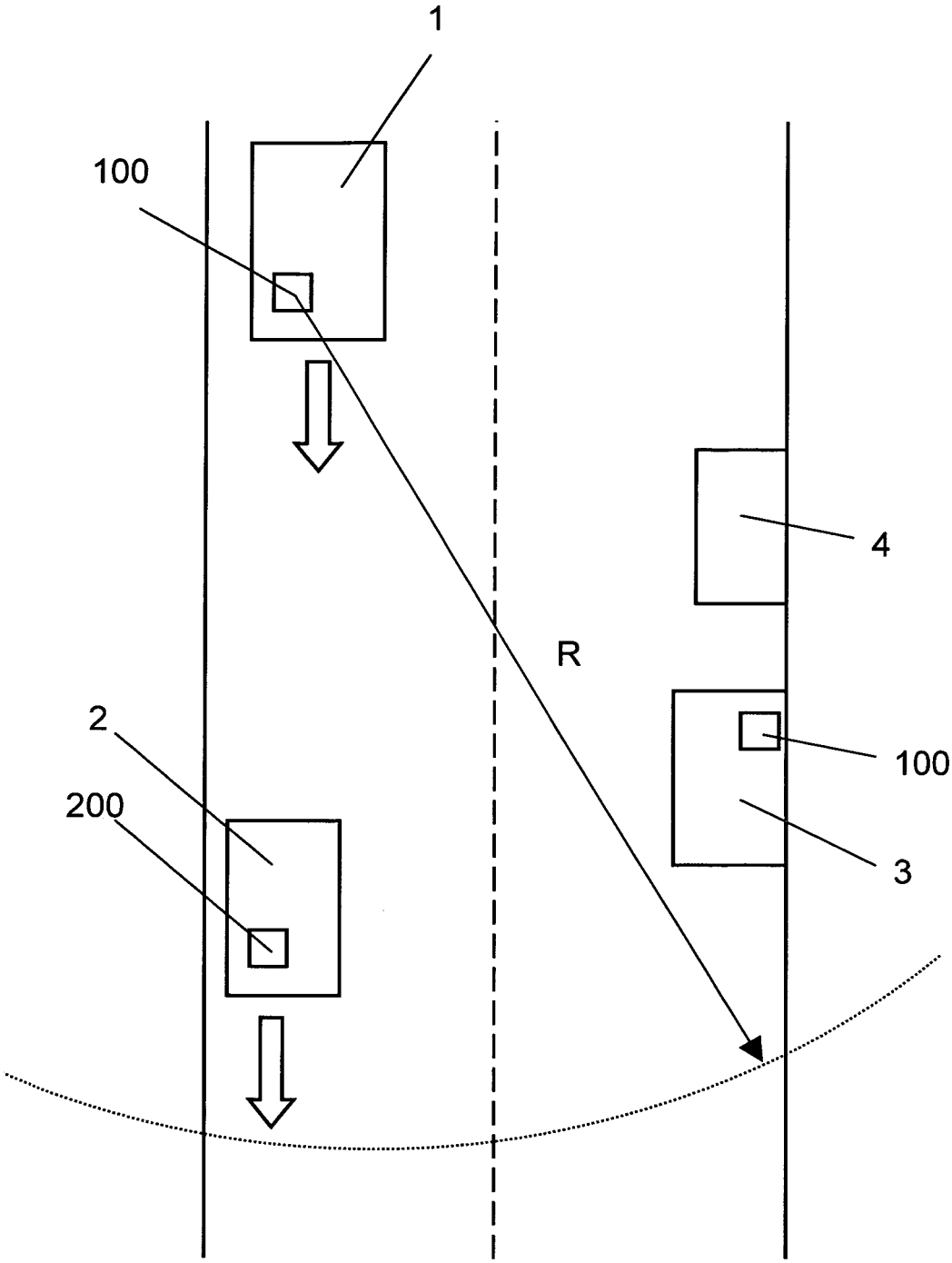

Further preferably, the method and system for transmitting a warning message to a driver of a vehicle according to a preferred embodiment of the invention comprises means for muting one transmitter 100 in the presence of another. For example, the emergency vehicle 1, such as an ambulance, requires right of way to pass the vehicle 2 while in the opposite direction a police car 3 is stopped behind vehicle 4. In this situation the ambulance 1 has a higher priority and the transmitter 100 of the police car 3 warning the traffic to slow down is muted while receiving transmitter priority data from the transmitter 100 of the emergency vehicle 1 within the range R, as illustrated in FIG. 1*b*.

To enable the above feature of muting a transmitter 100 in the presence of another transmitter 100, a RF signal indicative of transmitter priority data is transmitted. Preferably, the RF signal indicative of transmitter priority data is transmitted together with the RF signal indicative of the warning message. For example, the transmitter priority data are provided as a portion of the message data.

Further preferably, the radio transmitter 108 is a transmitter-receiver for receiving a RF signal while the encrypting module 106 is capable of decrypting and the encoding module 104 is capable of decoding. For example, these capabilities are provided in the CEL RF Module with PCB Trace Antenna. The transmitter priority data are then processed using, for example, control circuitry 116 for determining priority of the second transmitter and for generating priority control data in dependence upon the priority of the transmitter 100 and the second transmitter. If the second transmitter has a higher priority the control circuitry 116 generates priority control data indicative of abandonment of the transmission of the message data. For example, the transmission of the message data is abandoned for duration the RF signal indicative of transmitter priority data is received. The priority is determined, for example, in dependence upon the priority of the respective emergency vehicle. Alternatively, the transmitter priority data are determined in dependence upon a priority of each of the message data and are, for example, stored together with the respective message data or incorporated therein.

The receiver 200, illustrated in FIG. 2*b*, comprises as main components antenna 210, radio receiver 208, decrypting module 206, decoding module 204, and control circuitry 216 disposed on circuit board 201. The radio receiver 208 generates message data in dependence upon the RF signal received from the antenna 210 which are then decrypted in decrypting module 206 and decoded in decoding module 204, i.e. the components 204 to 210 perform the same process as the respective components 104 to 110 in the transmitter in reverse. Preferably, the decoding module 204, the decrypting module 206, the radio receiver 208, and the antenna 210 are integrated in a single chip 202 such as, for example, the off-the-shelf CEL RF Module with PCB Trace Antenna which receives a RF signal at a frequency of 2.4 GHz. Further preferably, a same chip 202 is employed as the chip 102 in the transmitter 100. It is noted that the off-the-shelf CEL RF Module with PCB Trace Antenna is a transmitter-receiver module.

The receiver 200 further comprises interface 220 and port 214 for being connected to the entertainment system of the vehicle. The receiver 200 is, preferably, provided with power and, therefore, in operation when the ignition key of the vehicle is turned, i.e. the receiver 200 is operated independent from the entertainment system of the vehicle. The control circuitry 216 controls operation of the entertainment system via interface 220 and provides the message data via port 214 such that the warning message is broadcast when the entertainment system is turned off and such that provision of other audio signals—for example, from the radio, CD player, or DVD player of the entertainment system—is interrupted for broadcasting the warning message when the entertainment system is turned on. The control circuitry 216 is, for example, a suitable off-the-shelf micro processor for executing executable commands stored in non-volatile memory 218.

Preferably, the control circuitry 216 controls broadcasting of the warning message such that the warning message is repeated in predetermined time intervals during reception of the RF signal. Optionally, the control circuitry 216 adjusts volume of the entertainment system to a predetermined level for broadcasting the warning message which is independent of a current volume level of the entertainment system and, for example, can not be changed by the driver of the vehicle.

Referring to FIG. 2*c*, a receiver 200A for use as a retrofit to existing entertainment systems is provided. The receiver 200A comprises audio processing module 212 for converting the decoded message data into a respective analog audio signal indicative of the warning message and for providing the same via the port 214 to at least a loudspeaker of the entertainment system. Here, the interface 220 comprises, for example, relays—controlled by the control circuitry 216—for interrupting provision of the audio signals to the loud speakers of the entertainment system when a warning message is received.

Referring to FIG. 3, a method for transmitting a warning message to a driver of a vehicle according to a preferred embodiment of the invention is provided. At 10, authorization for uploading message data is provided followed by the provision of message data indicative of a plurality of pre-recorded warning messages—12. The message data are then stored—16—in memory of the transmitter.

A responder of the emergency vehicle selects—18—one of the plurality of pre-recorded warning messages. The message data associated with the selected warning message are then encoded—20—and encrypted—22. Encryption/decryption of the message data substantially increases reliability of the system for transmitting a warning message to a driver of a vehicle by substantially reducing accidental or intentional triggering of the system. The encrypted message data are then processed to generate—24—a RF signal in dependence thereupon which is then transmitted—26—to the vehicle. Upon receipt of the RF signal at the vehicle—28—message data are generated in dependence thereupon—30—which are then decrypted—32—and decoded—34. The decoded message data are then provided—36—to the entertainment system of the vehicle and the operation of the entertainment system is controlled—38—such that the warning message is broadcast when the entertainment system is turned off and such that provision of other audio signals is interrupted for broadcasting the warning message when the entertainment system is turned on.

The transmitter 100 and the receiver 200 are designed using off-the-shelf components, standard engineering technologies and standard programming languages.

The present invention has been described herein with regard to preferred embodiments. However, it will be obvious to persons skilled in the art that a number of variations and modifications can be made without departing from the scope of the invention as described herein.

What is claimed is:

1. A device for transmitting a warning message to a driver of a vehicle comprising:

a storage medium for storing message data indicative of a plurality of pre-recorded warning messages;

a port connected to the storage medium, the port for receiving the message data and providing the same to the storage medium;

upload control circuitry connected to the port and the storage medium, the upload control circuitry for controlling provision of the message data in dependence upon a predetermined user authorization;

selecting circuitry connected to the storage medium, the selecting circuitry for selecting one of the plurality of pre-recorded warning messages;

an encoding module connected to the selecting circuitry, the encoding module for encoding the message data associated with the selected warning message;

an encryption module connected to the encoding module, the encryption module for encrypting the encoded message data;

a radio transmitter connected to the encryption module, the radio transmitter for generating a radio frequency signal in dependence upon the encrypted message data; and, an antenna connected to the radio transmitter, the antenna for transmitting the radio frequency signal to the vehicle.

2. The device as defined in claim 1 comprising transmitter priority control circuitry for receiving transmitter priority data indicative of a priority of a second transmitter and for generating priority control data indicative of abandonment of the transmission of the message data if the received transmitter priority data are indicative of a higher priority.

3. The device as defined in claim 2 wherein the radio transmitter is a radio transmitter-receiver for receiving a radio frequency signal indicative of a transmitter priority and generating transmitter priority data in dependence thereupon.

4. The device as defined in claim 1 wherein the encoding module, the encrypting module, the radio transmitter, and the antenna are integrated in a single chip.

5. A method for transmitting a warning message to a driver of a vehicle comprising:

providing message data indicative of a plurality of pre-recorded warning messages, wherein the message data are provided via a port connected to a storage medium and wherein provision of the message data is controlled in dependence upon a predetermined user authorization using an upload control circuitry connected to the port and the storage medium;

selecting one of the plurality of pre-recorded warning messages;

encoding the message data associated with the selected warning message;

encrypting the encoded message data; generating a radio frequency signal in dependence upon the encrypted message data;

transmitting the radio frequency signal to the vehicle;

receiving the radio frequency signal at the vehicle;

generating message data in dependence upon the received radio frequency signal decrypting the message data; decoding the decrypted message data;

providing the decoded message data; and, controlling operation of the entertainment system such that the warning message is broadcast when the entertainment system is turned off and such that provision of other audio signals is interrupted for broadcasting the warning message when the entertainment system is turned on.

6. The method as defined in claim 5 comprising providing transmitter priority data.

7. The method as defined in claim 6 wherein the transmitter priority data are provided as a portion of the message data.

8. The method as defined in claim 7 wherein the transmitter priority data are provided such that the transmitter priority data are indicative of a priority of the message data.

9. The method as defined in claim 5 comprising adjusting volume of the entertainment system to a predetermined level for broadcasting the warning message.

10. A device for transmitting a warning message to a driver of a vehicle comprising:

a storage medium for storing message data indicative of a plurality of pre-recorded warning messages;

selecting circuitry connected to the storage medium, the selecting circuitry for selecting one of the plurality of pre-recorded warning messages;

an encoding module connected to the selecting circuitry, the encoding module for encoding the message data associated with the selected warning message;

an encryption module connected to the encoding module, the encryption module for encrypting the encoded message data;

a radio transmitter connected to the encryption module, the radio transmitter for generating a radio frequency signal in dependence upon the encrypted message data;

an antenna connected to the radio transmitter, the antenna for transmitting the radio frequency signal to the vehicle; and, transmitter priority control circuitry for receiving transmitter priority data indicative of a priority of a second transmitter and for generating priority control data indicative of abandonment of the transmission of the message data if the received transmitter priority data are indicative of a higher priority.

11. The device as defined in claim 10 comprising a port connected to the storage medium, the port for receiving the message data and providing the same to the storage medium.

12. The device as defined in claim 11 comprising upload control circuitry connected to the port and the storage medium, the upload control circuitry for controlling provision of the message data in dependence upon a predetermined user authorization.

13. The device as defined in claim 10 wherein the radio transmitter is a radio transmitter-receiver for receiving a radio frequency signal indicative of a transmitter priority and generating transmitter priority data in dependence thereupon.

14. The device as defined in claim 10 wherein the encoding module, the encrypting module, the radio transmitter; and the antenna are integrated in a single chip.

* * * * *